US007422309B2

(12) United States Patent
Enomoto et al.

(10) Patent No.: US 7,422,309 B2
(45) Date of Patent: Sep. 9, 2008

(54) DROPLET DISCHARGING HEAD

(75) Inventors: Katsumi Enomoto, Kanagawa (JP); Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 413 days.

(21) Appl. No.: 10/947,230

(22) Filed: Sep. 23, 2004

(65) Prior Publication Data

US 2005/0062800 A1 Mar. 24, 2005

(30) Foreign Application Priority Data

Sep. 24, 2003 (JP) ..... 2003-332471

(51) Int. Cl.
*B41J 2/155* (2006.01)

(52) U.S. Cl. ..... 347/42; 347/71

(58) Field of Classification Search ..... 347/13, 347/42, 40, 43, 68, 71, 72
See application file for complete search history.

(56) References Cited

U.S. PATENT DOCUMENTS 5,160,945 A 11/1992 Drake
6,299,295 B1 * 10/2001 Miura et al. ..... 347/68
6,499,823 B2 12/2002 Okazaki et al.
6,984,022 B2 * 1/2006 Silverbrook ..... 347/49
2002/0048831 A1 4/2002 Nakamura et al.

FOREIGN PATENT DOCUMENTS

| | | | |
|---|---|---|---|
| EP | 0646466 | A2 | 4/1995 |
| JP | 5-138885 | A | 6/1993 |
| JP | 6-115071 | A | 4/1994 |
| JP | 6-328689 | A | 11/1994 |
| JP | 7-164636 | A | 6/1995 |
| JP | 9-277534 | A | 10/1997 |
| JP | 2002-67330 | A | 3/2002 |
| JP | 2002-86736 | A | 3/2002 |
| JP | 2002-210976 | A | 7/2002 |

* cited by examiner

*Primary Examiner*—Lamson D. Nguyen
(74) *Attorney, Agent, or Firm*—Birch, Stewart, Kolasch & Birch, LLP

(57) ABSTRACT

In the full line type droplet discharging head, discharge ports for discharging a liquid supplied by a liquid passage formed by laminating thin plates, as liquid droplets, are arranged in a line direction along a length corresponding to a full width of a recording medium; and a simple rigid member having higher rigidity than that of a structure constituted by laminating the thin plates is provided extending along the line direction.

20 Claims, 9 Drawing Sheets

DROPLET DISCHARGING HEAD

This Non-provisional application claims priority under 35 U.S.C. § 119(a) on patent application Ser. No(s).2003-322471 filed in Japan on Sept. 24, 2003, the entire contents of which are hereby incorporated by reference.

BACKGROUND OF THE INVENTION

1. Field of the Invention

The present invention relates to a droplet discharging head, and more particularly, to a droplet discharging head in a recording head such as a full line type inkjet head, formed to have a long dimension by laminating together thin plates, whereby warping in the longitudinal direction due to internal stress caused by bonding, heat, or the like, is suppressed.

2. Description of the Related Art

Image recording is known which uses a so-called inkjet method, wherein an image is recorded by discharging and propelling ink (ink droplets) from the nozzles of a recording head to deposit the ink onto recording paper, or the like. There are various ink discharge methods for recording heads (inkjet heads) based on an inkjet method. For example, known methods include: a piezoelectric method wherein the volume of a pressure chamber is caused to change by means of deformation of piezoelectric ceramics, ink is introduced into the pressure chamber from an ink supply passage when the volume is increased, and the ink inside the pressure chamber is discharged as a droplet from the nozzle when the volume of the pressure chamber is reduced; an electrostatic method for discharging ink by similarly changing the volume of the pressure chamber; or a thermal inkjet method, or the like, for heating ink and generating bubbles in the ink, and discharging ink by means of the expansive energy created when these bubbles grow, or the like.

For example, an inkjet head using a piezoelectric element has a laminated structure wherein piezoelectric elements, a vibrator plate, a flow passage plate formed with an ink supply passage and pressure chambers, a nozzle plate formed with ink discharge ports (orifice plates), and the like, are layered onto a substrate, the head being manufactured by bonding these thin plates together.

In an inkjet head of this kind formed by a laminated structure of thin plates, if the head has a long dimension, then it is liable to warping in the longitudinal direction, due to internal stress produced by the bonding and heating processes during manufacture. If warping occurs in the inkjet head, then problems occur, for example, the accuracy of the landing positions of the ink droplets discharged from the nozzles deteriorates, and image recording of high quality cannot be achieved, and therefore various methods for preventing warping of this kind have been proposed.

For example, a head is known whereby, in order to restrict the main body of the inkjet print cartridge in the critical direction, which is the direction following the surfaces of the laminated thin plates, after heating and cooling, thereby preventing bending of the nozzle members and separation from the barrier layers, the main body of the cartridge is formed in such a manner that the difference between the coefficient of thermal expansion of the main body of the cartridge in the critical direction and the coefficient of thermal expansion of the nozzle members in the critical direction is within approximately 100 ppm/° C. (see, for example, Japanese Patent Application Publication No. 7-164636).

However, in the technology described in Japanese Patent Application Publication No. 7-164636, even if the difference of the coefficient of thermal expansion is less than 100 ppm, some stress will be generated, and if the head has a long dimension, it will have insufficient strength, and a problem arises in that phenomena, such as warping, curling, and the like, will occur due to the stress generated.

Moreover, although not designed with the particular object of preventing warping, technology relating to a method for manufacturing an inkjet head of long dimension by arranging a plurality of short heads is also known, wherein, when manufacturing a full line type inkjet head of long dimension, by arraying a plurality of base bodies, on which energy converting elements and electrodes corresponding to respective nozzles are formed in an integral manner, on a supporting body, and forming a plurality of discharge ports for discharging ink by bonding with one ceiling plate in which a common liquid chamber, and the like, is formed, the divided base bodies are arrayed at uniform intervals on the supporting body, the plurality of base bodies are cut from the base substrate on which they are arranged, via cutting lines, and the plurality of base bodies thus cut are arranged on the supporting body by positioning the respective cutting lines thereof in a continuous fashion, in such a manner that the pitch error between the base bodies is reduced (see, for example, Japanese Patent Application Publication No. 9-277534).

However, in the technology described in Japanese Patent Application Publication No. 9-277534, the strength of the head is dependent on the strength of the supporting body and the ceiling plate, and since the base bodies are divided, there is liable to be insufficient strength at the connections between the respective base bodies, and warping, and the like, will be generated if the head is formed to have a relatively long dimension.

Furthermore, technology is also known, wherein a foundation plate provided with energy generating elements and a ceiling plate forming an ink passage in conjunction with the foundation plate, are sandwiched between two components (a base plate and ink supply member) made from materials having similar coefficient of thermal expansion (for example, from the same material), and are respectively pressed from either side (for example, screw fastenings, or the like), in such a manner that thermal deformation, warping, and the like, is prevented in the ceiling plate and the foundation plate forming the ink passage (see, for example, Japanese Patent Application Publication No. 2002-67330).

However, in the technology described in Japanese Patent Application Publication No. 2002-67330, a device for pressing the foundation plate and the ceiling plate by means of the base plate and the ink supply member is required, and hence the number of components increases. Moreover, in the technology described in Japanese Patent Application Publication No. 2002-67330, pressure is applied by means of screw fastenings, but a problem arises in that the stress is liable to concentrate in the region of the screws, and hence there is a risk of other damage occurring.

Furthermore, technology is also known wherein a resin section formed with an ink passage and ink discharge ports is taken, and a thermal deformation suppressing member extending in the direction in which the ink discharge ports are arranged, and having a smaller coefficient of thermal expansion than the resin section, is formed in an integral fashion with the resin section, whereby warping and deformation in the longitudinal direction (direction of arrangement of the ink discharge ports) is prevented (for example, Japanese Patent Application Publication No. 2002-210976).

However, in the technology disclosed in Japanese Patent Application Publication No. 2002-210976, since a resin section forming an ink passage and ink discharge ports, and a thermal deformation suppressing member, which is a structural element for reinforcing the strength of same, are formed together in an integral manner, the material is limited to being resin, which does not necessarily have sufficient strength.

SUMMARY OF THE INVENTION

The present invention is contrived in view of such circumstances, and an object thereof is to provide a droplet discharging head wherein the strength, in the longitudinal direction, of a full line type liquid discharging head forming a liquid passage by laminating together thin plates is increased, thereby preventing warping caused by internal stress, and the like, and maintaining stability, in addition to which the accuracy of the landing positions of the discharged droplets is also increased.

In order to attain the above-described object, the present invention is directed to a full line type droplet discharging head wherein discharge ports for discharging a liquid supplied by a liquid passage formed by laminating thin plates, as liquid droplets, are arranged in a line direction along a length corresponding to a full width of a recording medium; wherein a simple rigid member having higher rigidity than that of a structure constituted by laminating the thin plates is provided extending along the line direction. Here, the line direction indicates the width direction of the recording paper, being a direction that is orthogonal to the direction of conveyance of the recording paper, and this direction may also be described as the longitudinal direction of the full line type droplet discharging head.

Thereby, the strength of a full line type droplet discharging head of long dimension with respect to bending in the longitudinal direction thereof is increased, and hence, for example, warping in the longitudinal direction due to internal stress caused by processing, bonding, or the like, of the structure of thin plates during manufacture, can be prevented, thereby making it possible to guarantee the flatness of the discharge ports, increase the accuracy of the landing positions of the discharged droplets, and hence achieve image recording of high quality.

Preferably, the rigid member is provided along the line direction, in at least one of end portions of the droplet discharging head in a direction perpendicular to the line direction. By providing two structural members at both ends, it is possible to increase the strength yet further.

Preferably, a common liquid chamber extending along the line direction, for supplying the liquid to each of the discharge ports, is provided in the rigid member.

Preferably, wirings to pass current to electrodes for imparting energy for causing discharge of droplets to discharging devices for discharging the droplets from the discharge ports are disposed in the rigid member.

According to the present invention, the rigid members for reinforcing strength can be used for a variety of applications, and not simply for increasing the strength of the droplet discharging head in the longitudinal direction, and hence reinforcement of the strength can be ensured, without increasing the number of components.

As described above, according to the droplet discharging head relating to the droplet discharging head, in a full line type droplet discharging head of long dimension, the strength with respect to bending in the longitudinal direction thereof is increased, and hence warping in the longitudinal direction due to internal stress caused by processing, bonding, or the like, of the structure of thin plates during manufacture, can be prevented, thereby making it possible to guarantee the flatness of the discharge ports, increase the accuracy of the landing positions of the discharged droplets, and hence achieve image recording of high quality.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Below, the droplet discharging head relating to the present invention is described in detail with reference to the accompanying drawings.

Figure 1:
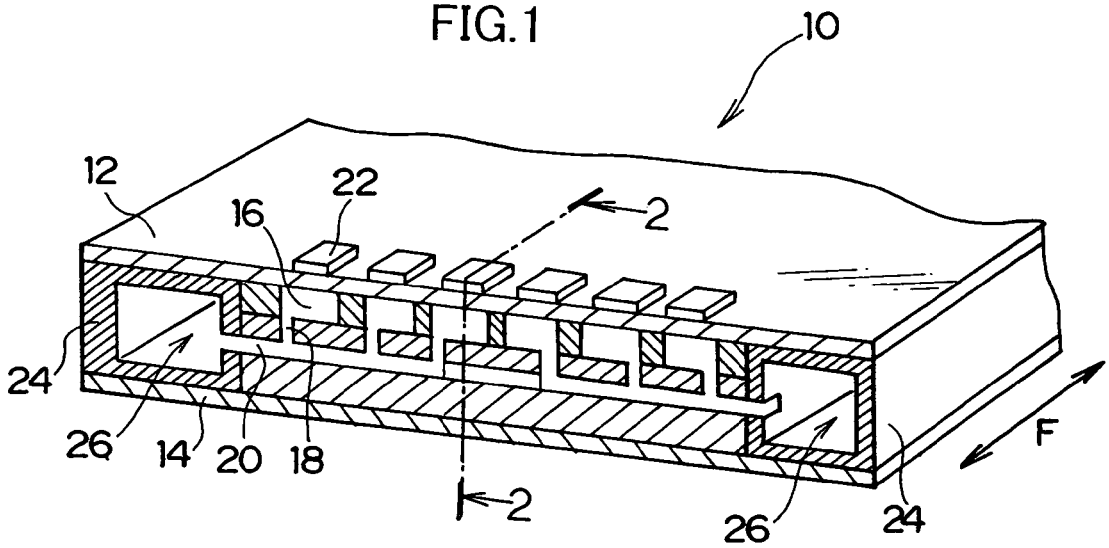
FIG. 1 is an approximate oblique view comprising a partial cross-sectional view showing a droplet discharging head according to an embodiment of the present invention.

FIG. 1 is an approximate oblique view comprising a partial cross-sectional view showing an approximate illustration of one embodiment of a droplet discharging head according to the present invention. In the droplet discharging head according to the present embodiment, a piezoelectric type droplet discharging head which discharges liquid droplets by pressurizing a liquid by changing the volume of a pressure chamber filled with a liquid by means of a deforming action of a piezoelectric element, is applied to an inkjet head, but the present invention is not limited to an inkjet head of this kind.

As shown in FIG. 1, the droplet discharging head 10 according to the embodiment of the present invention (hereinafter, called the "inkjet head 10") is constituted by a plurality of thin plates laminated between a ceiling plate 12 and a nozzle plate 14, and between these laminated bodies of thin plates, there are formed pressure chambers 16, ink supply ports (supply diaphragms) 18, tributaries 20 of an ink supply passage, and the like. Furthermore, piezoelectric elements 22 are disposed respectively in positions corresponding to the respective pressure chambers 16 on the ceiling plate 12.

A nozzle, which is an ink discharge port (not illustrated in FIG. 1), is provided in a connecting fashion to each of the pressure chambers 16. The pressure chambers 16 (and nozzles) are arranged in plural fashion in the longitudinal direction of the inkjet head 10 indicated by the arrow F in the diagram and in the shorter direction orthogonal to the longitudinal direction, being provided in a matrix fashion. In FIG. 1, a state is illustrated wherein six pressure chambers 16 are arranged in the shorter direction, and the arrangement in the longitudinal direction is omitted from the diagram.

Moreover, in the inkjet head 10 according to the present embodiment, a structural member 24 is provided between the ceiling plate 12 and the nozzle plate 14, at either end in the direction of the shorter dimension, in such a manner that it extends along the longitudinal direction. Each structural member 24 is provided along the longitudinal direction (line direction) so as to reinforce the strength of the inkjet head 10, in order to prevent warping in the longitudinal direction due to internal stress generated by processing, bonding of thin plates, or heating in order to harden the adhesive, or the like, during manufacture of the inkjet head 10. Here, the line direction means the direction of the width of the recording paper, which is the direction orthogonal to the direction of conveyance of the recording paper.

Since the structural members 24 are provided in order to reinforce the strength of the head, they need to be of high rigidity. For example, a simple reinforcing member having a rigidity greater than that of the laminated structure composed by laminating together thin plates, without a reinforcing member, is selected as the structural member 24. By reinforcing by means of a reinforcing member (rigid member) of this kind, a head structure is obtained which has a two-dimensional moment in cross-section, whereby warping of the head in the longitudinal direction can be prevented.

In FIG. 1, the structural members 24 are square bars extending in the longitudinal direction, which have a hollow interior. This hollow cavity is used as a common liquid chamber 26 for supplying ink to the respective pressure chambers 16. As shown in FIG. 1, a tributary 20 connected respectively to three pressure chambers 16 is connected to each of the common liquid chambers 26.

Figure 2:
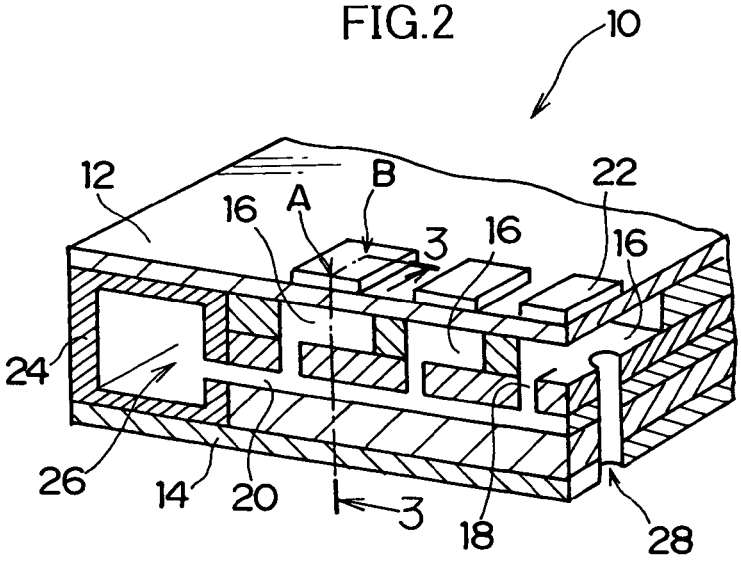
FIG. 2 shows an oblique view of the inkjet head shown in FIG. 1, including a partial cross-sectional view showing a cross-section taken along the line 2-2 in FIG. 1.

Moreover, FIG. 2 shows an oblique view of the inkjet head 10 shown in FIG. 1, including a partial cross-sectional view showing a cross-section taken along the dotted line 2-2 in FIG. 1. In other words, in FIG. 2, the cross-section taken along the line 2-2 in FIG. 1 is shown on the right-hand side. As this cross-sectional view reveals, holes extending from the pressure chambers 16 to the nozzle plate 14 are formed, and these holes form nozzles 28 from which ink is discharged. In FIG. 2, a nozzle 28 is depicted only in the pressure chamber 16 furthest to the right-hand side, but besides this, although not illustrated in the diagram, nozzles are formed in a similar manner in each of the other pressure chambers 16.

Figure 3:
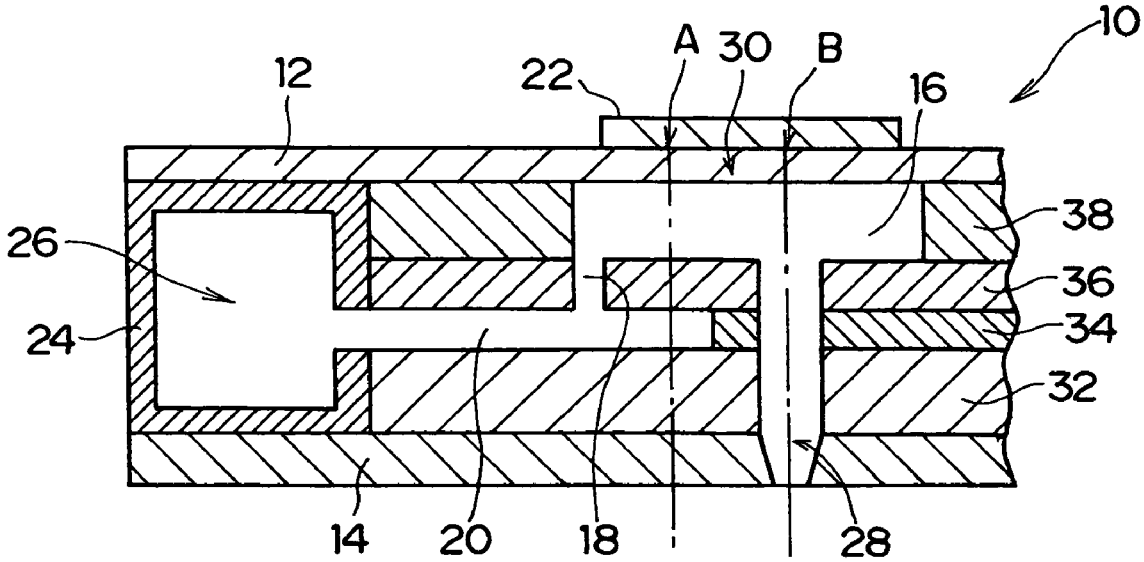
FIG. 3 is a diagram showing a side cross-section viewing the inkjet head in FIG. 2 from the front side in FIG. 2, and a cross-section taken along the line 3-3 in FIG. 2, as a single plane.

Furthermore, FIG. 3 shows a cross-section taken along the dotted line 3-3 in the oblique view of the inkjet head 10 shown in FIG. 2. As shown in FIG. 2, the line 3-3 starts a cross-section from point A, with respect to the inkjet head 10, and then changes the direction of the cross-section at point B which corresponds to a nozzle provided in the pressure chamber 16 through which the cross-section passes. Therefore, the cross-section does not show a single plane, but in FIG. 3, it is depicted in the form of a single plane, following the dotted lines A and B respectively at the positions corresponding to point A and point B.

As shown in FIG. 3, the inkjet head 10 according to the present embodiment is constituted by laminating together thin plates, in which pressure chambers 16, ink supply ports 18, and tributaries 20 of an ink supply passage, and the like, are formed, and furthermore, structural members 24 are provided in the end portions thereof in order to reinforce the strength in the longitudinal direction, common liquid chambers 26 being formed inside the structural members 24.

The inkjet head 10 according to the present embodiment is constituted by laminating a nozzle plate 14 in which nozzles 28 are pierced, an ink plate 32 forming the base face of a tributary 20 of an ink passage, a tributary plate 34 similarly forming the side walls of a tributary 20, an ink supply port plate 36 in which ink supply ports 18 are pierced, a pressure chamber plate 38 forming the side walls of pressure chambers 16, and a ceiling plate 12. Furthermore, the portion of the ceiling plate 12 forming the ceiling portion of a pressure chamber 16 forms a vibrating plate 30 on the upper face of the pressure chamber 16, a piezoelectric element 22 being disposed about this vibrating plate 30.

Although not illustrated in the drawings, the interior of the common liquid passages, 26, the tributaries 20, the ink supply ports 18, the pressure chambers 16 and the nozzles 28 are filled with ink. If a voltage is applied to a piezoelectric element 22 by means of an electrode (not illustrated in the drawings), then the piezoelectric element 22 performs a deforming operation, whereby the vibrating plate 30 is caused to bend and deform towards the pressure chamber 16, thereby changing the volume of the pressure chamber 16, and hence causing an ink droplet to be discharged from the nozzle 28 which is connected to the pressure chamber 16.

Next, a method for manufacturing the inkjet head 10 according to the present embodiment will be described.

Firstly, structural members 24 having common liquid chambers 26 formed respectively inside the structural members 24 are bonded onto the end portions of a nozzle plate 14 in which holes to form nozzles 28 are pierced. An ink plate 32 formed with holes to form nozzles 28, a tributary plate 34 formed with portions to form tributaries 20 and holes for nozzles 28, an ink supply port plate 36 formed with ink supply ports 18 and holes for nozzles 28, and a pressure chamber plate 38 formed with portions to form pressure chambers 16, are attached and bonded successively to the nozzle plate 14.

In this case, in each of the plates thus bonded, one side face of the plate is bonded in such a manner that it is attached to one of the side faces of the structural member 24. On top of these layers are also attached a ceiling plate 12 which also forms a vibrating plate 30, and finally, piezoelectric elements 22, in portions corresponding to the respective pressure chambers 16. In this way, lower face of either structural member 24 is attached to the nozzle plate 14, the upper face thereof is attached to the ceiling plate 12, and one side face thereof is attached to the side faces of the respectively laminated plates, whereby the structural member 24 is attached and fixed to other members on three of its four faces, and therefore sufficient suppressing force can be displayed with respect to warping of the inkjet head 10.

In the present embodiment, since structural members 24 which reinforce the strength in the longitudinal direction are incorporated in this manner when manufacturing an inkjet head 10, it is possible to prevent warping of the inkjet head 10 manufactured by laminating thin plates, in the longitudinal direction, due to internal stresses after bonding, and the like.

Moreover, as described above, in the present embodiment, since highly rigid structural members 24 are disposed in the longitudinal direction of the inkjet head 10, it is possible to alleviate decline in quality of the discharging characteristics due to bending of the head, by increasing the strength in the longitudinal direction of a head of long dimension. Furthermore, since the flatness of the nozzle surface is ensured by preventing warping due to internal stress, or the like, in a head of long dimension, then the accuracy of the landing positions of the ink droplets discharged from the nozzles can be increased, and hence image recording of high quality can be achieved.

Moreover, in the embodiment described above, the interior portions of the structural members 24 are taken to be hollow and are used as common liquid chambers 26 for supplying ink respectively to the various pressure chambers 16, but the structural members 24 are not restricted to being used as common liquid chambers 26 in this manner, and may also be used for various other purposes.

Figure 4:
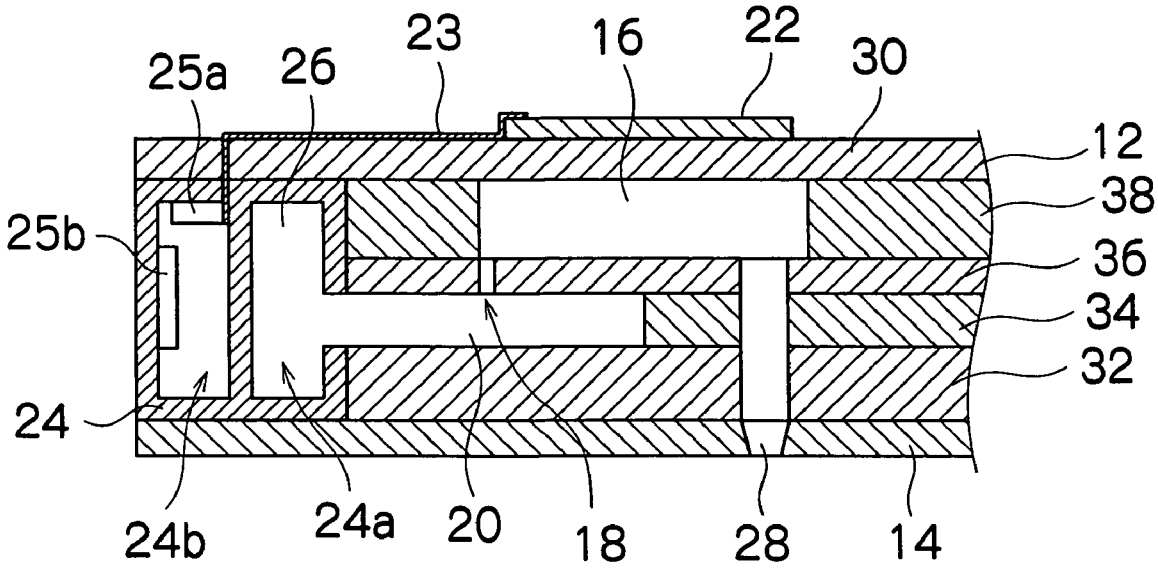
FIG. 4 is a diagram of the same view with FIG. 3, to show an example wherein electronic devices such as an IC are arranged inside the structural member.

In an example shown in FIG. 4, the interior of the structural member 24 is divided into two chambers 24*a* and 24*b*. The chamber 24*a* is used as a common liquid chamber 26 as described above. The other chamber 24*b* can be used to accommodate an electronic device 25*a* such as an IC, a heater or Peltier device 25*b*, or the like, and to lead a wiring 23 to the piezoelectric element 22.

Figure 5:
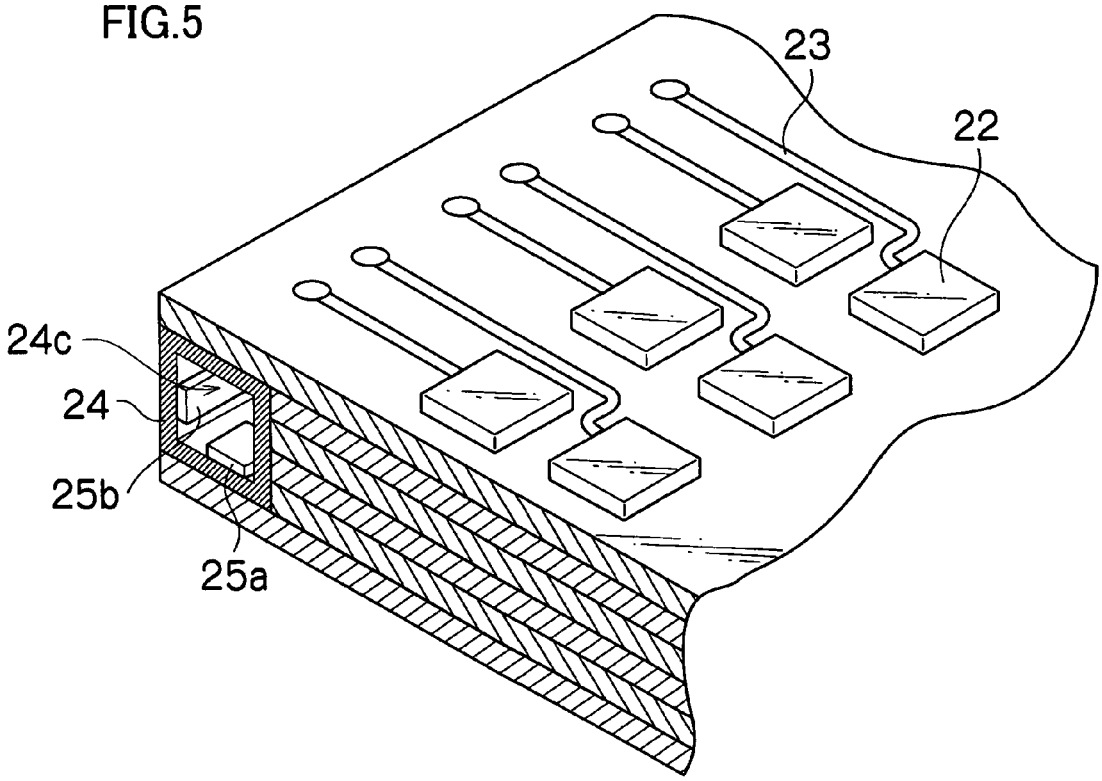
FIG. 5 is an oblique view comprising a partial cross-sectional view showing another example wherein electronic devices such as an IC are arranged inside the structural member.

The structural member 24 may be made from silicon, and an electrode pattern may be embedded inside the structural member 24. Alternatively, in an example shown in FIG. 5, the structural member 24 is similarly made from silicon, and an electronic device 25*a* such as an IC is disposed in a space 24*c* inside the structural member 24, thereby causing the structural member 24 to serve the function of a circuit board. Moreover, a heater or Peltier device 25*b*, or the like, may be provided in the space 24*c* inside the structural member 24, whereby the temperature of the whole of the common liquid chamber can be adjusted, in such a manner that the inkjet head 10 becomes less liable to the affects of the ambient environment.

Figure 6:
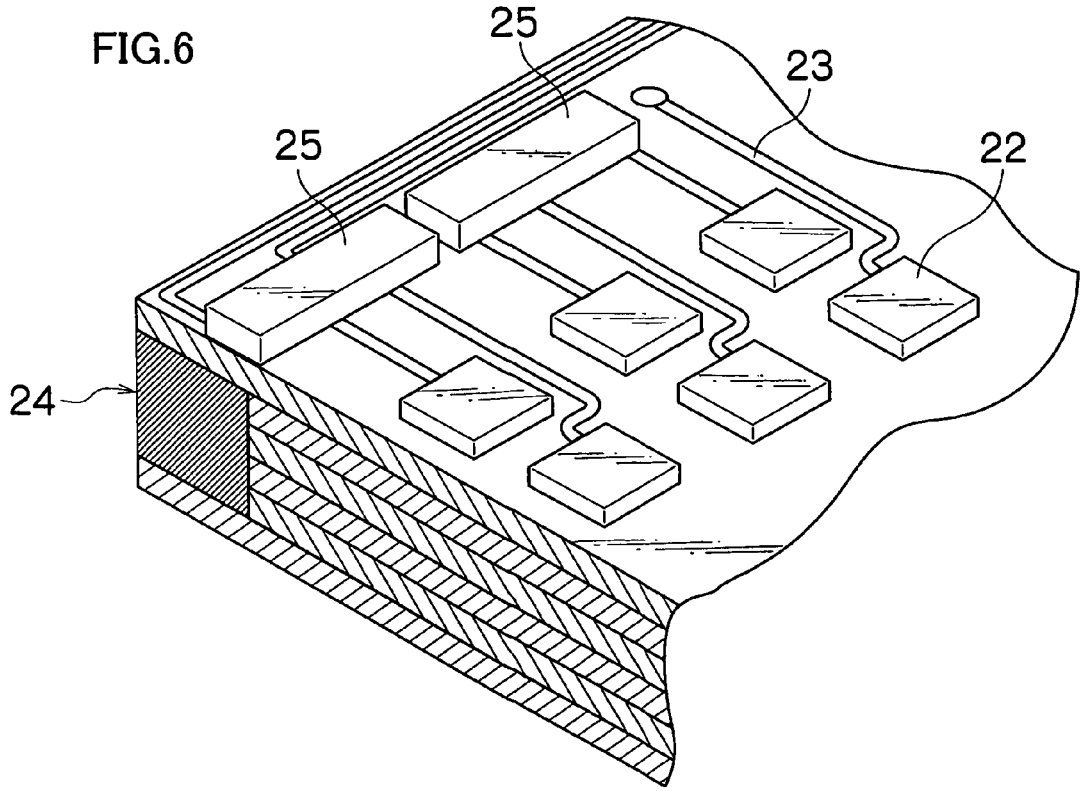
FIG. 6 is an oblique view comprising a partial cross-sectional view showing another example wherein the structural member is not hollow, and electronic devices such as an IC are arranged on the structural member.

In another example shown in FIG. 6, the interior of the structural member 24 is not hollow, and an IC, heater, Peltier device, and the like, are arranged on the upper surface of the structural member 24, on which the piezoelectric elements 22 are also arranged. As compared with the examples shown in FIG. 5, or the like, it is hence possible to reduce the processing to form the hollow inside the structural member 24, the heat radiation property is improved, and the wiring formation can be simplified.

Furthermore, in the embodiment described above, two structural members for reinforcing the strength in the longitudinal direction of an inkjet head of long dimension are disposed, one at either end of the head in the direction of the shorter dimension, but it is also possible to provide just structural member on one side only. If only one structural member is inserted, then this may be disposed on one side, but as shown in FIG. 7, the structural member 24 may also be disposed in the exact center of the inkjet head 10.

Figure 7:
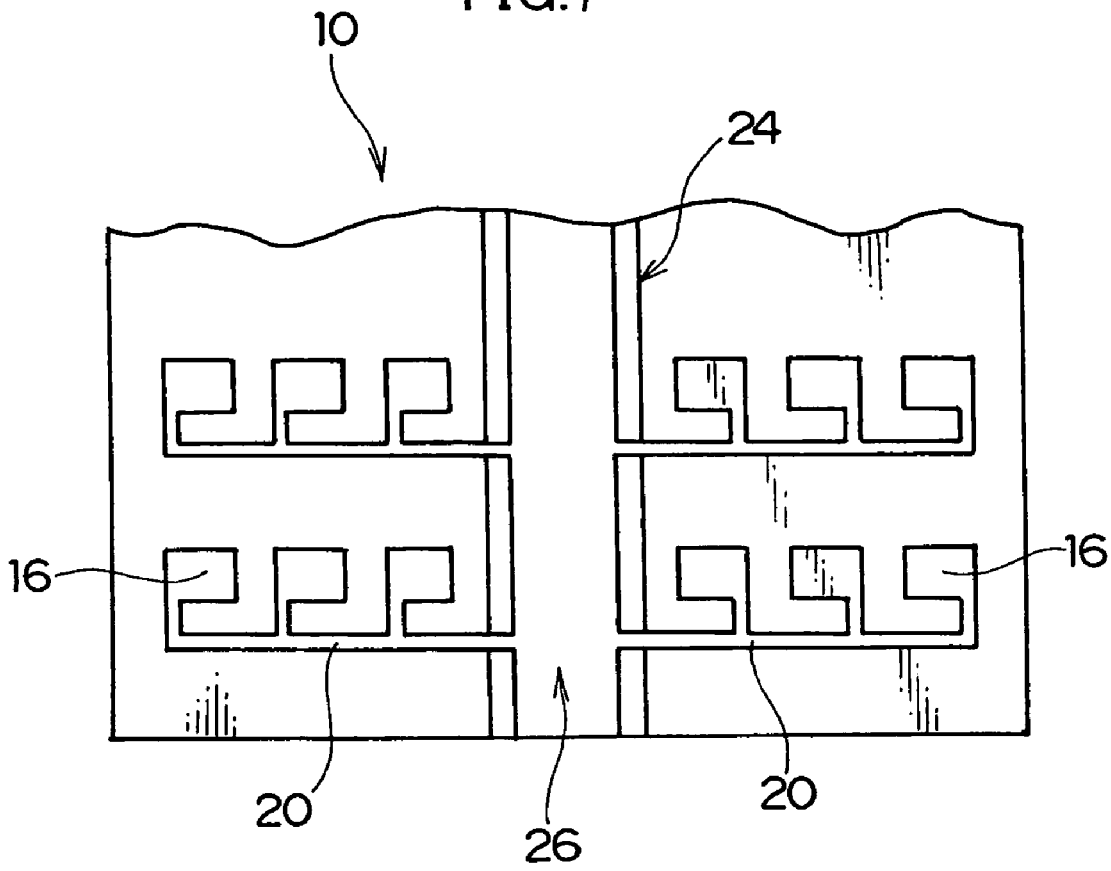
FIG. 7 is a plan view showing an example wherein a structural member is inserted into the exact center of the inkjet head.

In this case, as shown in FIG. 7, a common liquid chamber 26 is provided inside the structural member 24 disposed in the exact center of the inkjet head 10, similarly to the foregoing description, and tributaries 20 extend from same towards the left and right-hand sides in FIG. 7, in such a manner that ink is supplied to the respective pressure chambers 16 disposed on either side. Thereby, it is possible to supply ink to the respective pressure chambers 16 in a more even fashion than in a case where ink is supplied from one side.

Figure 8:
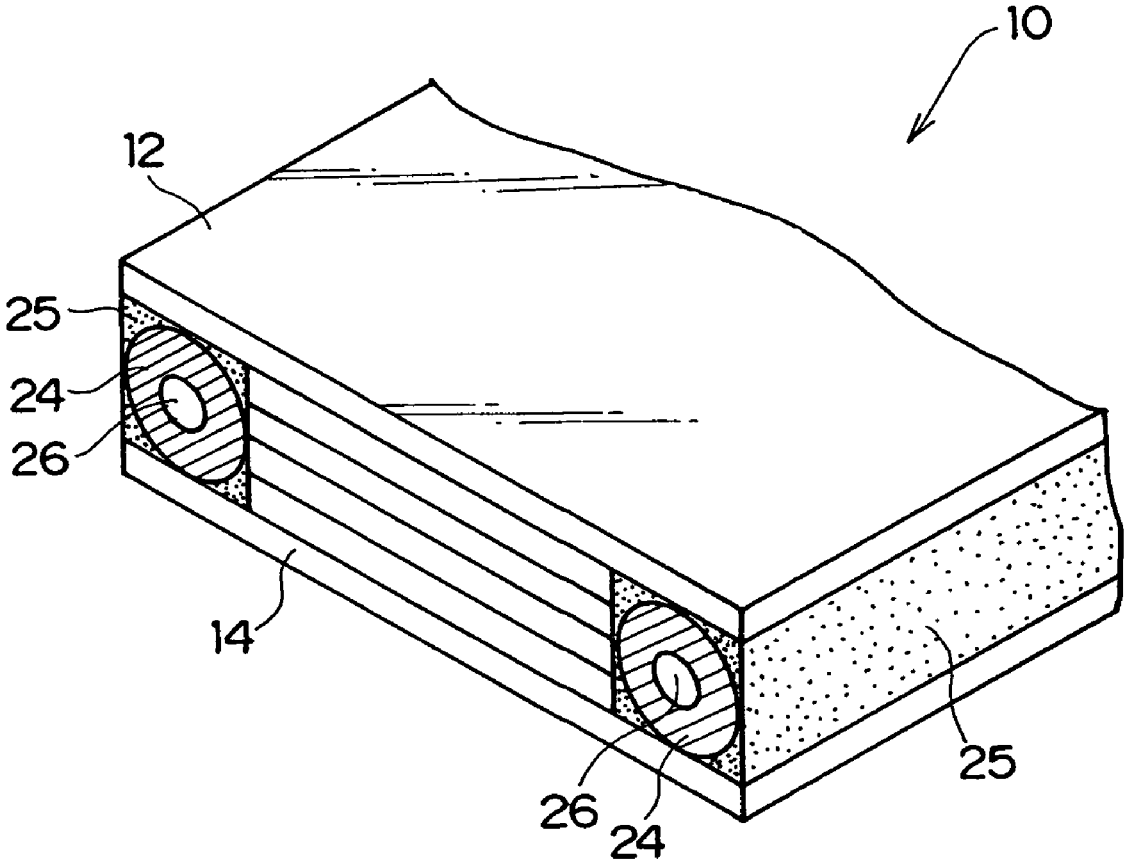
FIG. 8 is an oblique diagram showing an example of an inkjet head wherein the structural members are hollow, round bars.

Moreover, the form of the structural members 24 is not limited to being a square bar shape as described above, and it is also possible, for example, to use the interior portion of the structural members 24 as a common liquid chamber 26 by forming each structural member 24 as a round bar shape, as illustrated in FIG. 8, and using the hollow internal cavity thereof as a pipe. If a round bar shape is adopted, fabrication becomes easier and less expensive. Moreover, it is also possible to increase the sealing characteristics of the flow passages by filling in the gaps between the respective plates and the structural members 24, by means of resin or adhesive.

Figure 9:
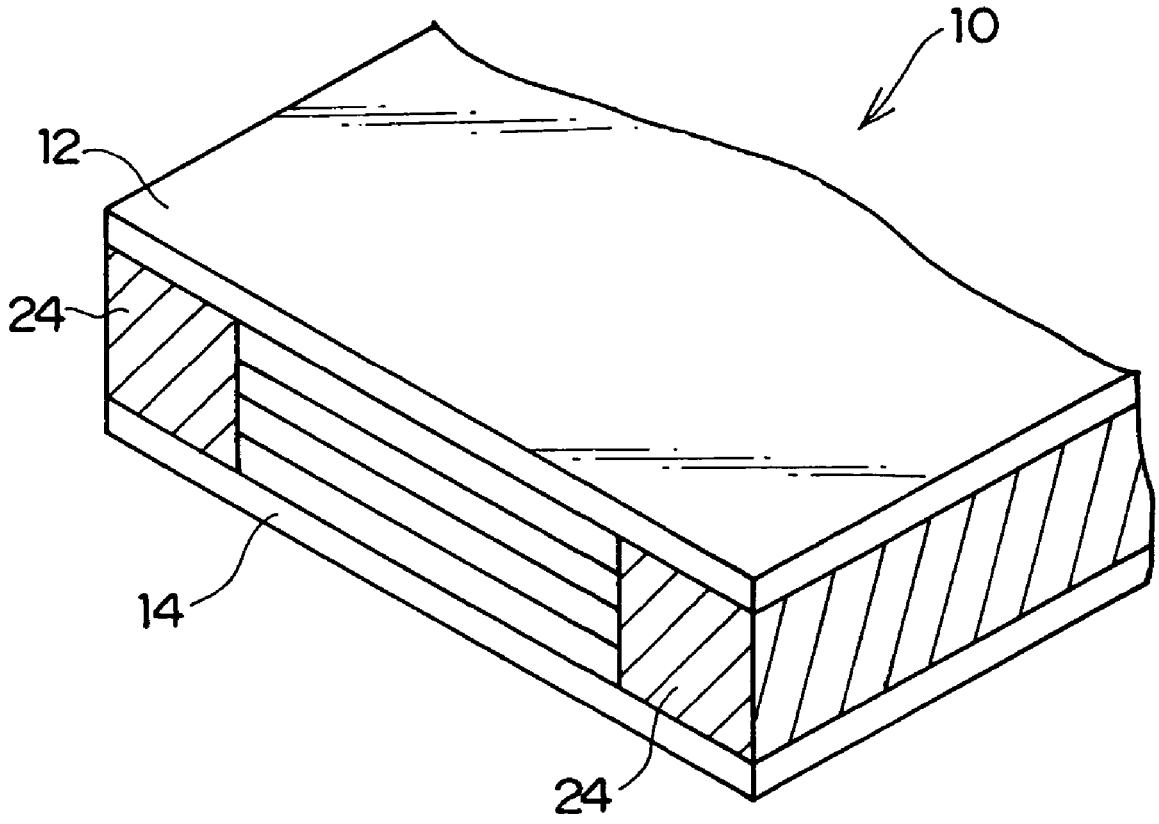
FIG. 9 is an oblique diagram showing an example of an inkjet head wherein the structural members are solid-centered square bars.

Furthermore, as shown in FIG. 9, is also possible for the structural members 24 to have a square bar shape which does not comprise a hollow interior, in other words, a member which is not provided with a common liquid chamber therein and is used solely for the purpose of reinforcing the strength of the head.

Figure 10:
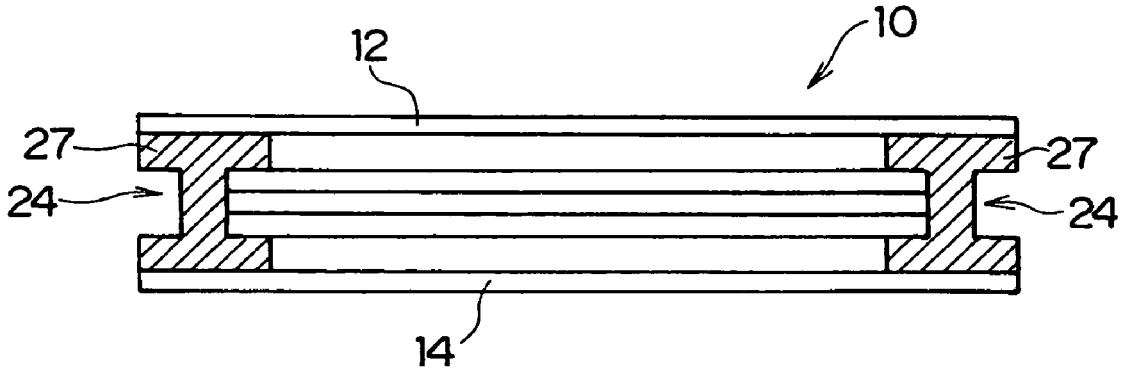
FIG. 10 is a front view showing an example of an inkjet head wherein the structural members are formed with an I-shaped cross section.
Figure 11:
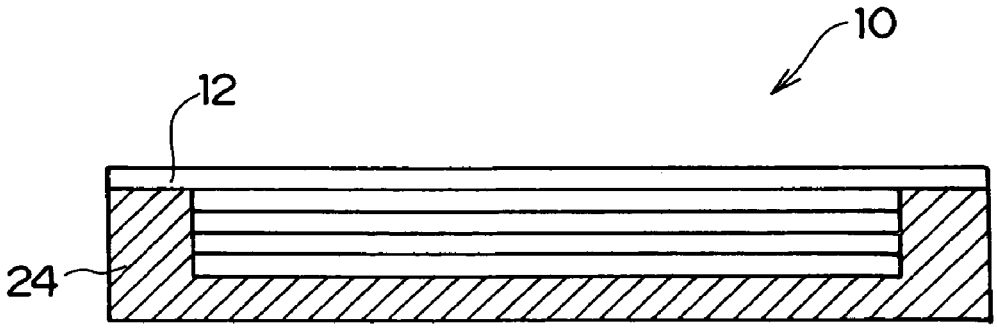
FIG. 11 is a front view showing an example of an inkjet head wherein the structural member is formed with a square U-shaped cross section.

Moreover, from the viewpoint of reinforcing the strength, a variety of forms for the structural members 24 can be envisaged. For example, as shown in FIG. 10, they may have an I-shaped cross-section, in which case greater rigidity is provided, the greater the width of the flange sections 27. Moreover, as shown in FIG. 11, the structural member 24 may be formed in a square U shape, in such a manner that the thin plates are laminated into the open mouth portion thereof. Rigidity in this case is higher than if structural members are inserted at either end in the direction of the shorter dimension, and more particularly, in this case, it is also possible to prevent warping in the direction of the shorter dimension.

In the case of the structural members 24 illustrated in FIGS. 9 to 11 also, it is of course possible to form common liquid chambers inside the members, or in positions about the periphery thereof, by means of the structural members. For example, if the structural members have an I-shaped cross-section as in FIG. 10, then it is possible to form a common liquid chamber in the space formed by the flanges and the web on the side adjacent to the layered thin plates.

Furthermore, even if a head of long dimension is fabricated by joining together short head, in a full line configuration, by inserting structural members extending throughout the entire full line, it is possible to reinforce the strength at the respective connections between the short heads.

Furthermore, when an inkjet head of long dimension is manufactured, the structural members are preferably inserted from the beginning in order to prevent warping, but it is also possible to manufacture a head by laminating the thin plates by bonding whilst maintaining them in a state which prevents warping by means of other members of high rigidity, and then removing them from these supporting members after lamination, and inserting the structural members for reinforcing the strength.

As described above, according to the present embodiment, in a full line type inkjet head of long dimension constituted by laminating thin plates, it is possible to increase strength against bending in the longitudinal direction and hence prevent warping in the longitudinal direction, by disposing structural members which extend along the longitudinal direction. Furthermore, since decline in the quality of the discharging characteristics due to bending of the head can be restricted, and since the flatness of the nozzle surface cane be ensured, then the accuracy of the landing positions of the ink droplets discharged from the nozzles can be increased, and hence image recording of high quality can be achieved.

Moreover, it is also possible to provide hollow cavities inside the structural members, and to use these as common liquid chambers, or as conduits for electrodes from the piezoelectric elements, or for other various uses, and hence by using the structural members for various other applications and not simply for reinforcing the strength, it is possible to reduce the number of components and to simplify manufacture of the head.

Figure 12:
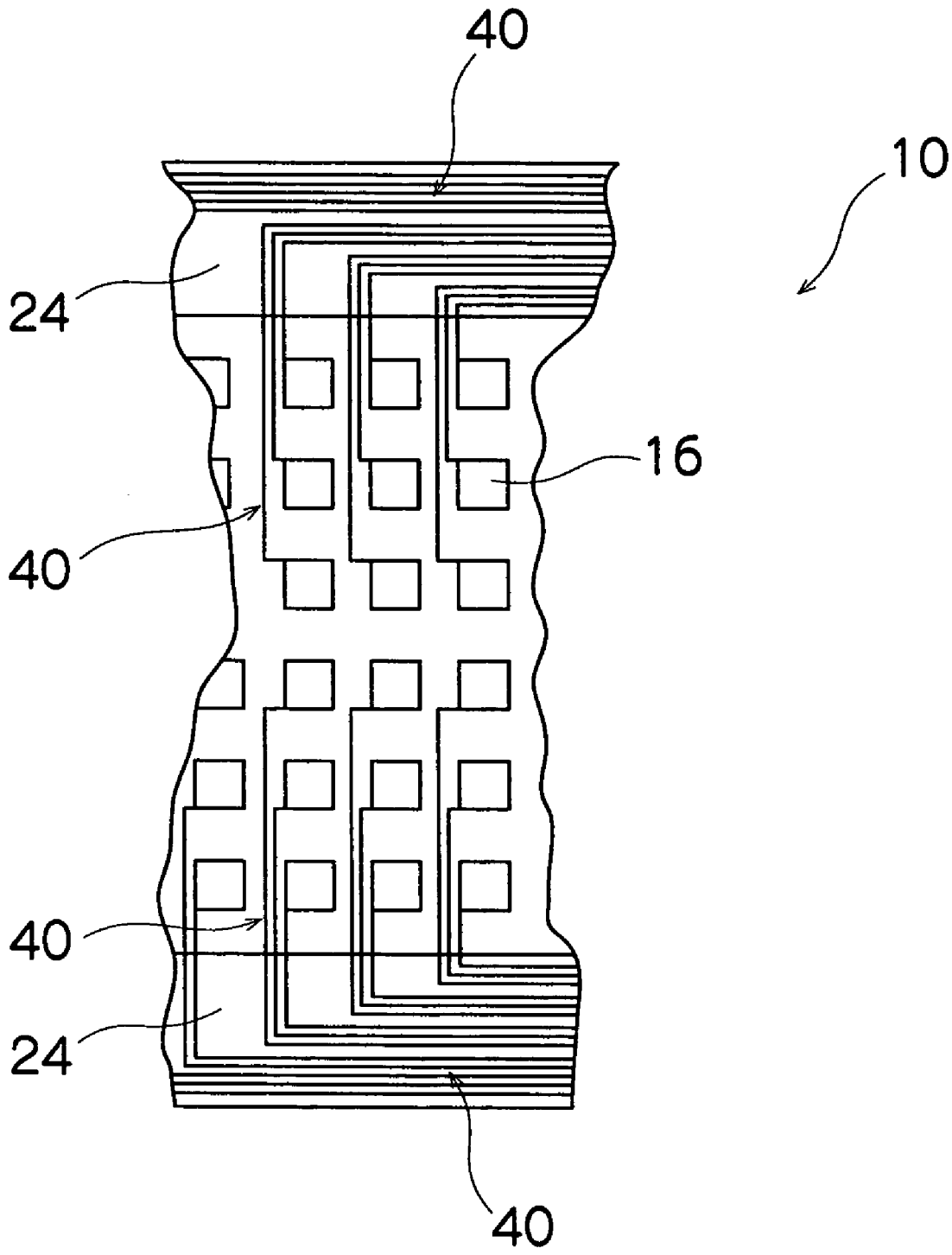
FIG. 12 is a plan view showing an example of the structural members in which the wirings are arranged.

For example as shown in FIG. 12, the structural members 24 are disposed in the longitudinal direction of the inkjet head 10 at the upper and lower sides thereof in FIG. 12. Wirings 40 to pass current to the electrodes of the piezoelectric elements (not shown) arranged at the pressure chambers 16 are led toward the upper or lower structural member 24 from the pressure chambers 16. The wirings 40 led from the pressure chambers 16 are disposed inside the upper and lower structural members 24. Thereby, the structure of the inkjet head 10 can be simplified.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A full line type droplet discharging head comprising:

a liquid passage formed by laminating thin plates;

discharge ports for discharging as liquid droplets liquid supplied by the liquid passage, the discharge ports arranged in a line direction along a length corresponding to a full width of a recording medium; and rigid member which is attached to the laminated thin plates so as to extend along the line direction and has higher rigidity than that of the laminated thin plates.

2. The droplet discharging head as defined in claim 1, wherein the rigid member is provided along the line direction, in at least one of end portions of the droplet discharging head in a direction perpendicular to the line direction.

3. The droplet discharging head as defined in claim 2, wherein a common liquid chamber extending along the line direction, for supplying the liquid to each of the discharge ports, is provided in the rigid member.

4. The droplet discharging head as defined in claim 3, wherein wirings to pass current to electrodes for imparting energy for causing discharge of droplets to discharging devices for discharging the droplets from the discharge ports are disposed in the rigid member.

5. The droplet discharging head as defined in claim 2, wherein wirings to pass current to electrodes for imparting energy for causing discharge of droplets to discharging devices for discharging the droplets from the discharge ports are disposed in the rigid member.

6. The droplet discharging head as defined in claim 1, wherein a common liquid chamber extending along the line direction, for supplying the liquid to each of the discharge ports, is provided in the rigid member.

7. The droplet discharging head as defined in claim 6, wherein wirings to pass current to electrodes for imparting energy for causing discharge of droplets to discharging devices for discharging the droplets from the discharge ports are disposed in the rigid member.

8. The droplet discharging head as defined in claim 6, wherein the rigid member is comprised of silicon.

9. The droplet discharging head as defined in claim 8, wherein an electrode pattern is embedded inside the rigid member.

10. The droplet discharging head as defined in claim 8, wherein at least one of a plurality of electronic devices is disposed within the rigid member.

11. The droplet discharging head as defined in claim 8, wherein a heating unit or cooling unit is disposed within the rigid member.

12. The droplet discharging head as defined in claim 6, wherein the common liquid chamber is quadrilateral in shape.

13. The droplet discharging head as defined in claim 6, wherein the common liquid chamber is circular in shape.

14. The droplet discharging head as defined in claim 1, wherein wirings to pass current to electrodes for imparting energy for causing discharge of droplets to discharging devices for discharging the droplets from the discharge ports are disposed in the rigid member.

15. The droplet discharging head as defined in claim 1, wherein two chambers are provided within the rigid member the first chamber being a common liquid chamber extending along the line direction, for supplying the liquid to each of the discharge ports; and the second chamber extending along the line direction, for accommodating at least one of a plurality of electronic devices.

16. The droplet discharging head as defined in claim 1, wherein at least one of a plurality of electronic devices is disposed above the rigid member on the same plane as discharging devices for discharging the droplets from the discharge ports.

17. The droplet discharging head as defined in claim 1, wherein a distance between opposing edges of an upper portion of the rigid member and a distance between opposing edges of a lower portion of the rigid member are greater than a distance between the opposing edges of a middle portion of the rigid member.

18. The droplet discharging head as defined in claim 1, wherein a common liquid chamber extending along the line direction, for supplying the liquid to each of the discharge ports, is bounded on a plurality of edges by the upper portion of the rigid member, the lower portion of the rigid member and the middle portion of the rigid member.

19. The droplet discharging head as defined in claim 1, wherein the rigid member extends beneath the thin plates such that the thin plates are laminated onto a middle portion of the rigid member.

20. The droplet discharging head as defined in claim 1, wherein the rigid member is quadrilateral in shape.

* * * * *